US011004577B1

(12) United States Patent
Seong

(10) Patent No.: US 11,004,577 B1
(45) Date of Patent: May 11, 2021

(54) CABLE TYPE LIQUID LEAK SENSOR

(71) Applicant: Beak Myeong Seong, Seongnam-si (KR)

(72) Inventor: Beak Myeong Seong, Seongnam-si (KR)

( * ) Notice: Subject to any disclaimer, the term of this patent is extended or adjusted under 35 U.S.C. 154(b) by 0 days.

(21) Appl. No.: 17/032,714

(22) Filed: Sep. 25, 2020

(30) Foreign Application Priority Data

Mar. 4, 2020 (KR) ..... 10-2020-0027348

(51) Int. Cl.

| | |
|---|---|
| ***H01B 11/00*** | (2006.01) |
| ***H01B 7/32*** | (2006.01) |
| ***H01B 7/28*** | (2006.01) |
| ***H01B 7/08*** | (2006.01) |

(52) U.S. Cl.
CPC ..... *H01B 7/322* (2013.01); *H01B 7/0876* (2013.01); *H01B 7/2813* (2013.01)

(58) Field of Classification Search
CPC .... H01B 7/322; H01B 7/0876; H01B 7/2813; H01B 7/32; G01R 31/08; G01R 27/00; G01M 3/16; G01M 3/18; G01M 31/08
USPC ..... 174/110 R, 110 FC, 115, 116 R, 117 R, 174/117 F, 117 FF; 324/512, 525, 527, 324/555, 557, 52, 425, 439; 73/40, 73/40.5 R
See application file for complete search history.

(56) References Cited

U.S. PATENT DOCUMENTS

| | | | | |
|---|---|---|---|---|
| 2,666,093 A * | 1/1954 | Widberg | H01P 3/04 | 174/117 R |
| 3,981,181 A * | 9/1976 | Ochiai | G01M 3/045 | 73/40.5 R |
| 4,029,889 A * | 6/1977 | Mizuochi | G01M 3/045 | 174/11 R |
| 4,206,632 A * | 6/1980 | Suzuki | G01M 3/165 | 174/11 R |
| 4,386,231 A * | 5/1983 | Vokey | H01B 7/322 | 174/115 |
| 4,594,638 A * | 6/1986 | Suzuki | G01M 3/165 | 174/11 R |
| 4,677,371 A * | 6/1987 | Imaizumi | G01M 3/165 | 174/11 R |
| 4,843,305 A * | 6/1989 | Akiba | G01M 3/165 | 340/605 |

(Continued)

FOREIGN PATENT DOCUMENTS

KR 10-1286316 B1 7/2013

*Primary Examiner* — William H. Mayo, III
(74) *Attorney, Agent, or Firm* — Rabin & Berdo, P.C.

(57) ABSTRACT

A cable type liquid leak sensor includes a first cable unit having a first detection line for detecting a leaking liquid and a first power line in parallel twisted with the first detection line for supplying a power source, a second cable unit having a second detection line for detecting a leaking liquid and a second power line in parallel twisted with the second detection line for supplying a power source, a first fixing unit formed to surround the outside of the first cable unit by a thread made of a chemical-resistant or drug-tolerant material, a second fixing unit formed to surround the outside of the second cable unit by a thread made of a chemical-resistant or drug-tolerant material, and a connection unit having both sides braided to couple the first and second fixing units so that the first and second cable units maintain a given interval.

6 Claims, 5 Drawing Sheets

(56) References Cited

U.S. PATENT DOCUMENTS

| | | | | | |
|---|---|---|---|---|---|
| 4,918,977 | A * | 4/1990 | Takahashi | G01M 3/045 | 174/11 R |
| 5,015,958 | A * | 5/1991 | Masia | G01M 3/165 | 324/522 |
| 5,235,286 | A * | 8/1993 | Masia | G01M 3/165 | 174/11 R |
| 5,381,097 | A * | 1/1995 | Takatori | G01M 3/045 | 174/47 |
| 6,144,209 | A * | 11/2000 | Raymond | G01M 3/165 | 174/11 R |
| 6,777,947 | B2 * | 8/2004 | McCoy | G01M 3/165 | 324/449 |
| 6,784,371 | B2 * | 8/2004 | Goehlich | G01M 3/042 | 174/110 R |
| 7,081,759 | B2 * | 7/2006 | Raymond | G01M 3/165 | 324/449 |
| 8,063,309 | B2 * | 11/2011 | Raymond | G01M 3/165 | 174/113 R |
| 8,234,910 | B2 * | 8/2012 | Raymond | G01M 3/165 | 73/40 |
| 8,256,269 | B2 * | 9/2012 | Raymond | H05K 13/04 | 73/40 |
| 2020/0395148 | A1 * | 12/2020 | Gibson | D07B 5/002 | |

* cited by examiner

CABLE TYPE LIQUID LEAK SENSOR

BACKGROUND

1. Technical Field

The present disclosure relates to a liquid leak sensor, and more particularly, to a cable type liquid leak sensor for detecting a leaking liquid, such as water, acid, alkali, oil, or an organic solvent, using a capacitance, resistance or conductivity method.

2. Related Art

Korean Patent No. 10-1286316 (entitled "Cable and System for Heat and Liquid Leakage Sensing") suggests a leaking liquid detection cable having "a leaking liquid detection line including a hygroscopic insulator through which moisture is absorbed or passes through and a pair of conductors adjacent to each other, surrounded by the hygroscopic insulator, and having a varying resistance value when moisture is absorbed or passes through the hygroscopic insulator; and attached to the outer circumference surface of an outer cover."

In such a conventional technology, the hygroscopic insulator is formed to surround the conductors. Surrounding moisture is absorbed or passes through the hygroscopic insulator, and moisture comes into contact with the conductors.

Furthermore, the pair of conductors is configured to be adjacent to each other and surrounded by the hygroscopic insulator. When moisture is absorbed or passes through the hygroscopic insulator, a leaking liquid is detected based on a change in the resistance value.

According to such a conventional technology, when a conductive liquid, such as water, is introduced into an adjacent conductor and comes into contact with the conductor, a resistance value is changed. However, the conventional technology has a problem in that when a nonconductive liquid, that is, oil or an organic solvent is introduced into an adjacent conductor and comes into contact with the conductor, the nonconductive liquid is not detected because there is no a change in the resistance value.

That is, the leaking liquid detection cable according to the conventional technology cannot be used as a capacitance sensor.

PRIOR ART DOCUMENT

1. Korean Patent No. 10-1286316
(Cable and System for Heat and Liquid Leakage Sensing)

SUMMARY

Various embodiments are directed to the provision of a cable type liquid leak sensor in which a pair of detection lines is positioned in parallel and the pair of detection lines is braided to maintain an equal interval in a length direction using a Teflon thread material that is strong against an acid or alkali solution, thus being capable of detecting a leaking liquid using a resistance or conductivity method and also detecting a leaking liquid, such as water, acid, alkali, oil, or an organic solvent, using a capacitance method.

According to an embodiment, a cable type liquid leak sensor includes a first cable unit having a first detection line for detecting a leaking liquid and a first power line in parallel twisted with the first detection line in order to supply a power source, a second cable unit having a second detection line for detecting a leaking liquid and a second power line in parallel twisted with the second detection line in order to supply a power source, a first fixing unit formed to surround the outside of the first cable unit by a thread made of a material having a chemical-resistant property or a drug-tolerance property, a second fixing unit formed to surround the outside of the second cable unit by a thread made of a material having a chemical-resistant property or a drug-tolerance property, and a connection unit having both sides braided to couple the first fixing unit and the second fixing unit so that the first cable unit and the second cable unit maintain a given interval.

Furthermore, the first fixing unit and the second fixing unit are formed simultaneously when the connection unit is braided.

Furthermore, the first fixing unit or the second fixing unit is wound along the outer circumference of the first cable unit or the second cable unit by the thread. A piece of the wound thread has an interval from a piece of a thread wound in the length direction of the first cable unit or the second cable unit.

Furthermore, the detection line and the power line are wound on the outside of the first cable unit or the second cable unit around a core wire in a spiral form.

Moreover, the first detection line is configured by coating, on a surface of a base having a form of a wire made of stainless steel, a composition for an electrode comprising positively charged and reduced graphene oxide. The second detection line is configured by coating, on a surface of a base having a form of a wire made of stainless steel, a composition for an electrode comprising negatively charged and reduced graphene oxide. The positively charged and reduced graphene oxide is represented by surface charges having an $NH3^+$ functional group. The negatively charged and reduced graphene oxide is represented by surface charges having a $COO^-$ functional group.

Furthermore, each of the compositions for the electrodes includes the charged and reduced graphene oxide of 5 to 20 wt %, a binder of 30 to 60 wt % which is oil-based fluorine resin, a solvent of 30 to 50 wt %, a hardener of 20 to 60 wt %, and a dispersant of 5 to 20 wt %.

DESCRIPTION OF REFERENCE NUMERALS

Figure 1:
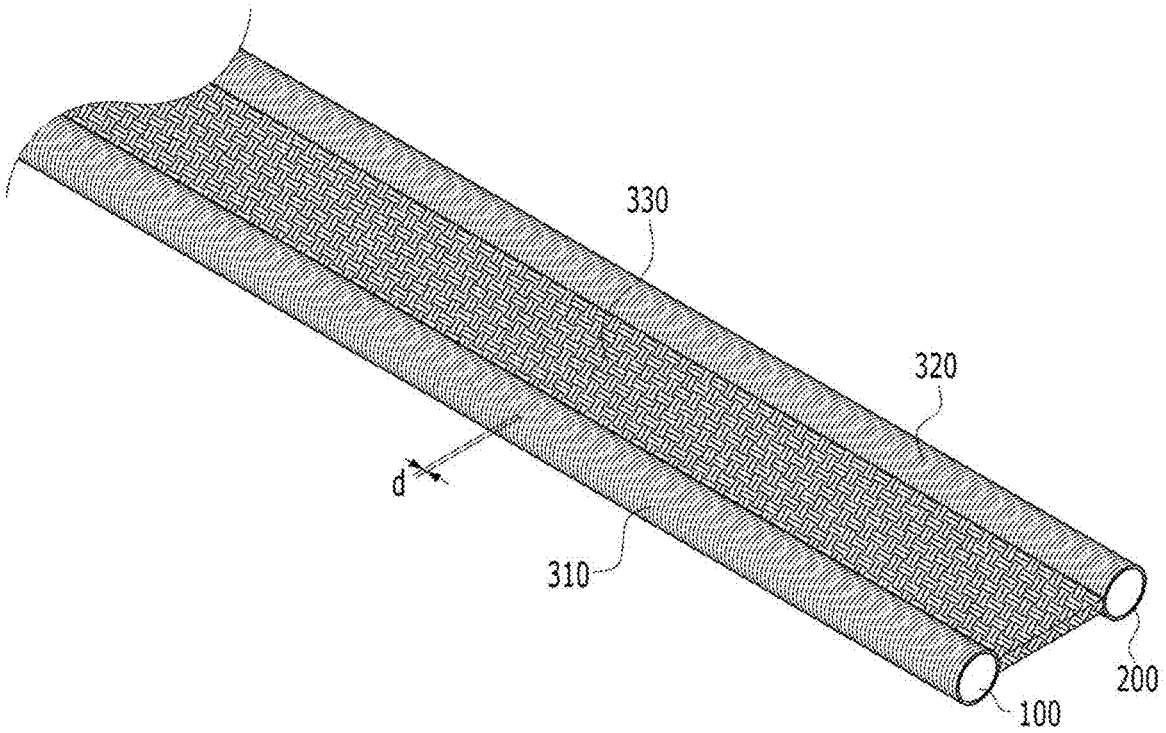
FIG. 1 is a diagram illustrating the structure of a cable type liquid leak sensor according to an embodiment of the present disclosure.

100: first cable unit
110: first core wire
120: first power line
130: first detection line
200: first cable unit
210: first core wire
220: first power line
230: first detection line
310: first fixing unit
320: second fixing unit
330: connection unit

DETAILED DESCRIPTION

The aforementioned objects, characteristics, and merits are described in detail with reference to the accompanying drawings, and thus a person having ordinary skill in the art to which the present disclosure pertains may readily practice the technical spirit of the present disclosure.

In describing the present disclosure, a detailed description of a known art related to the present disclosure will be omitted if it is deemed to make the gist of the present disclosure unnecessarily vague.

Common terms which are now widely used are selected as terms used in the present disclosure by taking into consideration functions in the present disclosure, and the terms may be different depending on an intention of a technician skilled in the art, a precedent, or the advent of a new technology.

Furthermore, in a specific case, some terms are randomly selected by the applicant. In this case, the meaning of a corresponding term will be described in detail in a descriptive part of a corresponding invention.

Accordingly, terms used in the present disclosure should not be simply defined based on their names, but should be defined based on their substantial meanings and contents over the present disclosure.

Hereinafter, embodiments of the present disclosure are described in detail with reference to the accompanying drawings.

However, the embodiments of the present disclosure may be modified in various other forms, and the scope of the present disclosure is not limited to the following embodiments.

The embodiments of the present disclosure are provided to a person having ordinary knowledge in the art to more fully describe the present disclosure.

Figure 2:
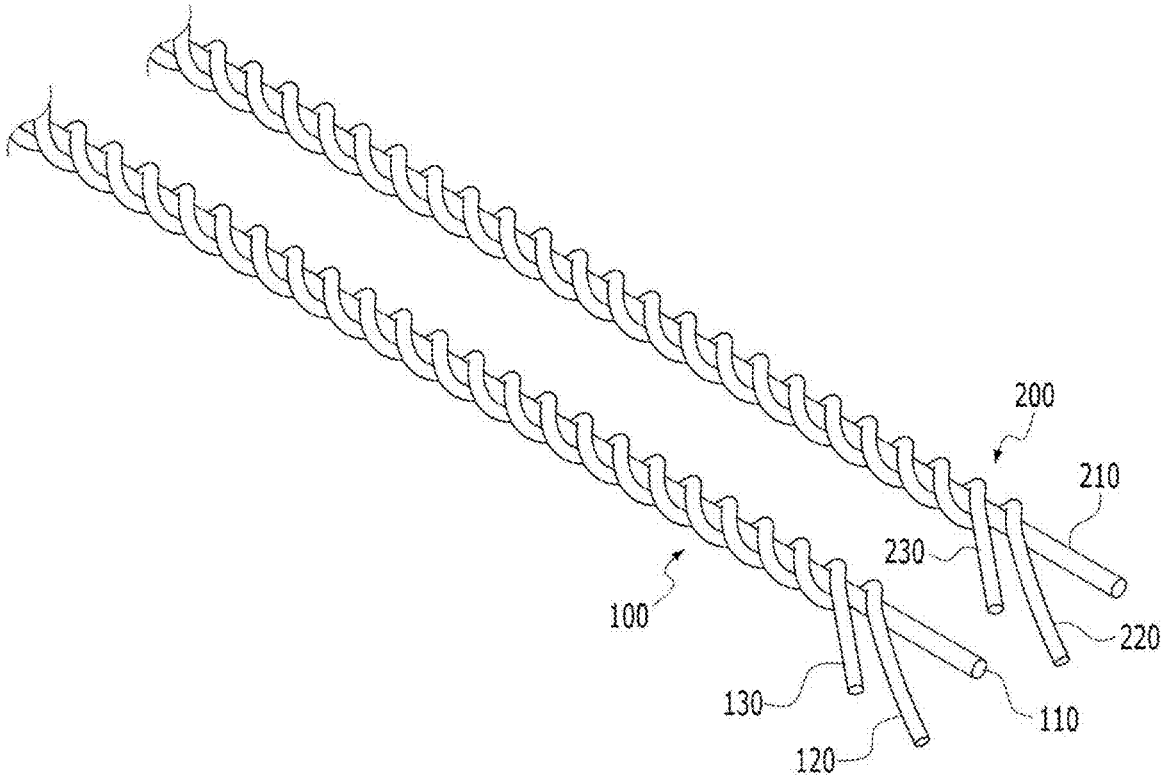
FIG. 2 is a diagram illustrating the structure of a pair of cable units formed according to an embodiment of the present disclosure.
Figure 3:
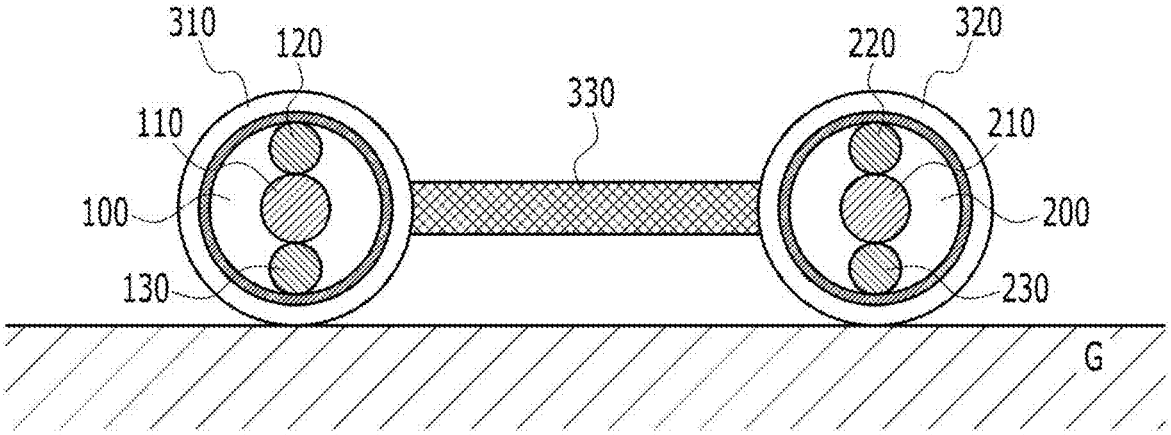
FIG. 3 is a diagram illustrating a cross section of the structure of FIG. 2.

FIG. 1 is a diagram illustrating the structure of a cable type liquid leak sensor according to an embodiment of the present disclosure. FIG. 2 is a diagram illustrating the structure of a pair of cable units formed according to an embodiment of the present disclosure. FIG. 3 is a diagram illustrating a cross section of the structure of FIG. 2.

According to an embodiment of the present disclosure, as illustrated in FIG. 1, a pair of cable units, that is, a first cable unit 100 and a second cable unit 200, are positioned in parallel. The first cable unit 100 and the second cable unit 200 maintain a given interval by a connection unit 330. The first cable unit 100 and the second cable unit 200 are coupled by a first fixing unit 310 and a second fixing unit 320, respectively, on both sides of the connection unit 330.

Accordingly, when a leaking liquid, such as acid, alkali, oil, or an organic solvent, is introduced between the first cable unit 100 and the second cable unit 200, the leaking liquid is detected using a capacitance method, a resistance method, or an electrical conductivity method.

In particular, if the leaking liquid is detected using the capacitance method, it is very important for the first cable unit 100 and the second cable unit 200 to maintain a given interval because the interval between the first cable unit 100 and the second cable unit 200 is an important element to determine detection performance.

To this end, according to an embodiment of the present disclosure, the first fixing unit 310, the second fixing unit 320, and the connection unit 330 are braided so that the first cable unit 100 and the second cable unit 200 maintain a given interval by a thread having a chemical-resistant property, a drug-tolerance property, a chemical-resistant property and a drug-tolerance property, representatively, a Teflon thread. In particular, the connection unit 330 is formed to a thickness in a knitted textile form.

As illustrated in FIG. 2, in the first cable unit 100, a first power line 120 and a first detection line 130 are twisted in a spiral form and wound on the outside of a first core wire 110 made of a stainless steel (SUS) wire.

SUS 304, 316, or 316L may be used as the first core wire 110. The first cable unit 100 may be configured with only the first power line 120 and the first detection line 130 twisted together without the first core wire 110.

The first core wire 110, the first power line 120, and the first detection line 130 may be twisted together to form one first cable unit 100.

The first power line 120 is twisted with the first detection line 130 in parallel and provides a power source, a communication signal, or a frequency to the first detection line 130. The first power line 120 and the first detection line 130 may have ends on one side coupled, so a power source, a communication signal, or a frequency from the first power line 120 may be provided to the first detection line 130 or transmitted to a remote place.

The first power line 120 has a form of an electric wire on which covering is coated. The first power line 120 is covered by a Teflon material in order to have a chemical-resistant property and a drug-tolerance property.

Furthermore, the first detection line 130 is an electrode. The first detection line is formed by coating, on the outside surface of a wire made of stainless steel, a composition for an electrode including graphene oxide. Accordingly, the first detection line has a chemical-resistant property, a drug-tolerance property, a chemical-resistant property and a drug-tolerance property, and is used as an electrode.

Likewise, the second power line 220 and second detection line 230 of the second cable unit 200 are configured to have the same structures as the first power line 120 and first detection line 130 of the first cable unit 100. In some embodiments, the second core wire 210 of the second cable unit 200 may be omitted.

The first cable unit 100 and the second cable unit 200 configured as described above are positioned in parallel. In this state, the first fixing unit 310 and the second fixing unit 320 are formed so that the Teflon thread is wound on the circumference of each of the first cable unit 100 and the second cable unit 200 with an interval between the Teflon threads.

That is, a piece of the Teflon thread or a single piece of the Teflon thread formed by twisting several pieces of the Teflon threads is wound on the outer circumferences of the first cable unit 100 and the second cable unit 200 to form the first fixing unit 310 and the second fixing unit 320. The piece of the wound Teflon thread has an interval "d" from a piece of a thread wound in the length direction of the first cable unit 100 or the second cable unit 200.

The interval "d" may be an irregular interval because it is based on braiding rather than a given interval. The interval "d" may be about 0.1 to 1 mm in order to protect the first cable unit 100 and the second cable unit 200.

The first fixing unit 310 and the second fixing unit 320 are braided and simultaneously the connection unit 330 is braided. As illustrated in FIG. 3, the connection unit 330 is braided in a form of a knitted textile having a thickness. Accordingly, the first cable unit 100 and the second cable unit 200 can maintain a given interval because the connection unit 330 is not easily folded.

The connection unit 300 has a thickness, that is, about 30 to 60% of the thickness of the first cable unit 100 or the second cable unit 200, so that the connection unit 300 has a bearing power for maintaining the interval.

Furthermore, side portions that belong to the first fixing unit 310 and the second fixing unit 320 and that face each other are braided and integrated on both sides of the connection unit 330.

Accordingly, when a leaking liquid, such as water, acid, alkali, oil, or an organic solvent, occurs, the leaking liquid comes into contact with the first detection line 130 and the second detection line 230 through the interval "d". Accordingly, the leaking liquid is detected.

That is, if the resistance method is used, a change in impedance of the leaking liquid can be detected. If the conductivity method is used, a change in the conductivity of the leaking liquid can be detected. If the capacitance method is used, a change in the capacitance of a conductive liquid or a nonconductive liquid can be detected.

Furthermore, after the detection, the leaking liquid may be removed by a cleaning work. For example, if a cleaning solution is sprayed, the cleaning solution washes the leaking liquid that has permeated the first fixing unit 310, the second fixing unit 320, and the connection unit 330. Furthermore, since the cleaning solution and the leaking liquid are easily discharged to the outside, a cleaning work is very easy, and the cable type liquid leak sensor can be repeatedly reused.

Furthermore, since the connection unit 330 is braided with flexibility, adhesion with the surface G of the earth is excellent when the cable type liquid leak sensor is installed on a bottom. Accordingly, detection performance is precise and excellent because a leaked liquid accurately comes into contact with the first cable unit 100 and the second cable unit 200.

Moreover, after the first fixing unit 310, the second fixing unit 320, and the connection unit 330 are formed, the first cable unit 100 and the second cable unit 200 may be inserted and fixed to the first fixing unit 310 and the second fixing unit 320 each having a ring form, respectively.

Each of the first detection line 130 and the second detection line 230 is formed by coating, on the outside surface of a wire made of stainless steel, a composition for an electrode including graphene oxide. The detection line has a chemical-resistant property, a drug-tolerance property, a chemical-resistant property, and a drug-tolerance property and is used as an electrode. The first detection line 130 is coated by a composition for an electrode including positively charged and reduced graphene oxide, thus forming an electrode. The second detection line 230 is coated by a composition for an electrode including negatively charged and reduced graphene oxide, thus forming an electrode.

The wire type base of each of the first detection line 130 and the second detection line 230 may be stainless steel or a conductive wire.

According to an embodiment of the present disclosure, graphene is used as the composition for an electrode. Graphene is a two-dimensional carbon sheet configured with carbon atoms, and shows a wide specific surface area, excellent heat conductivity, and a fast electron migration characteristic compared to the existing nano material.

Graphene may be physically separated layer by layer. Such a method is not suitable for mass production, and makes it impossible to fabricate large area graphene. Another method is a chemical peeling-off method for graphite, that is, a manufacturing process using an oxidation process. If such a method is used, a manufacturing cost is reduced, mass production is possible, and graphene oxide that allows various applications can be obtained because generated graphene is functionalized.

The graphene oxide may have a smaller number of layers than graphene using a physical method.

Several functional groups, such as an epoxy group, a hydroxyl group, a carbonyl group, and a carboxy group, are present on a surface of the graphene oxide obtained through the oxidation process.

According to an embodiment of the present disclosure, in order to use the graphene oxide as an element of the electrode, the graphene oxide is reduced and used as reduced graphene oxide (rGO).

In particular, according to an embodiment of the present disclosure, when the reduced graphene oxide is fabricated, the reduced graphene oxide having a polarity is used. In this case, the sensitivity of a capacitance type sensor can be significantly improved.

A cable type liquid leak sensor according to an embodiment of the present disclosure may be fabricated by performing the steps of forming the first detection line 130 by coating, on a base, a composition for an electrode including positively charged and reduced graphene oxide, forming the second electrode 230 by coating, on the base, a composition for an electrode including negatively charged and reduced graphene oxide, and performing hardening.

Figure 4:
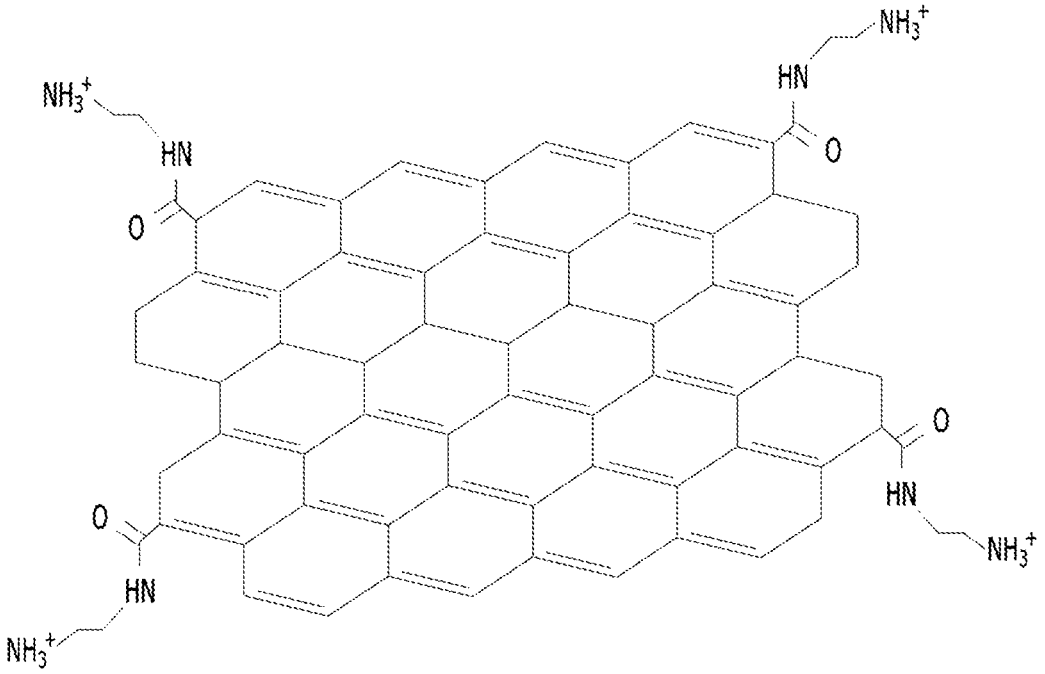
FIG. 4 is a diagram illustrating positively charged and reduced graphene oxide coated on a surface of a detection line.
Figure 5:
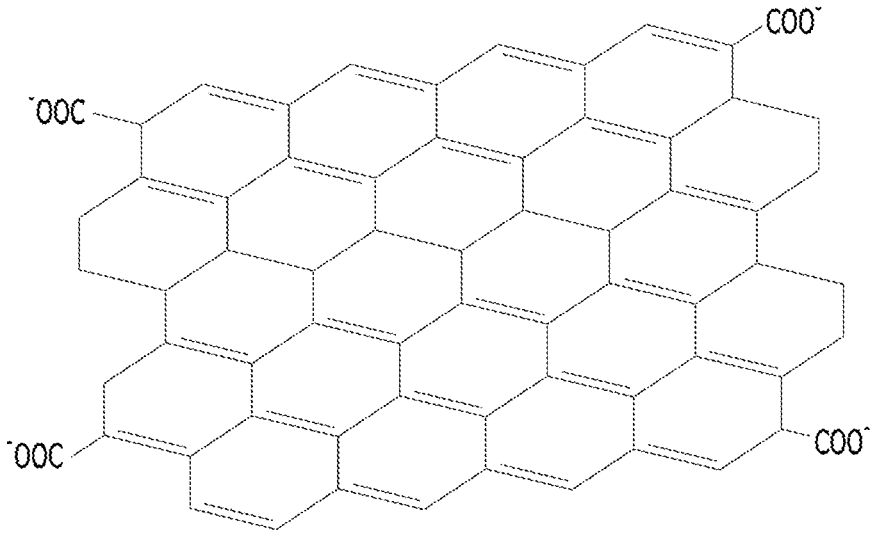
FIG. 5 is a diagram illustrating negatively charged and reduced graphene oxide.

FIG. 4 is a diagram illustrating positively charged and reduced graphene oxide coated on a surface of a detection line. FIG. 5 is a diagram illustrating negatively charged and reduced graphene oxide. In the composition for an electrode according to an embodiment of the present disclosure, the charged and reduced graphene oxide is used in the electrode.

Reduction graphene which may be obtained by reducing graphene oxide may be used as an electrode because it has conductivity unlike insulating graphene oxide.

According to an embodiment of the present disclosure, in particular, positively charged and reduced graphene oxide or negatively charged and reduced graphene oxide, among reduced graphene oxides, is used.

The positively charged and reduced graphene oxide may have surface charges represented by an $NH3^+$ functional group (FIG. 4). The negatively charged and reduced graphene oxide may have surface charges represented by a $COO^-$ functional group (FIG. 5).

The reduced graphene oxide having the $NH3^+$ functional group or $COO^-$ functional group may be obtained by reducing graphene oxide with the $NH3^+$ functional group or $COO^-$ functional group left when the graphene oxide is reduced.

If the reduced graphene oxide is charged, a value of a change in capacitance related to the sensitivity of a sensor is affected.

Figure 6:
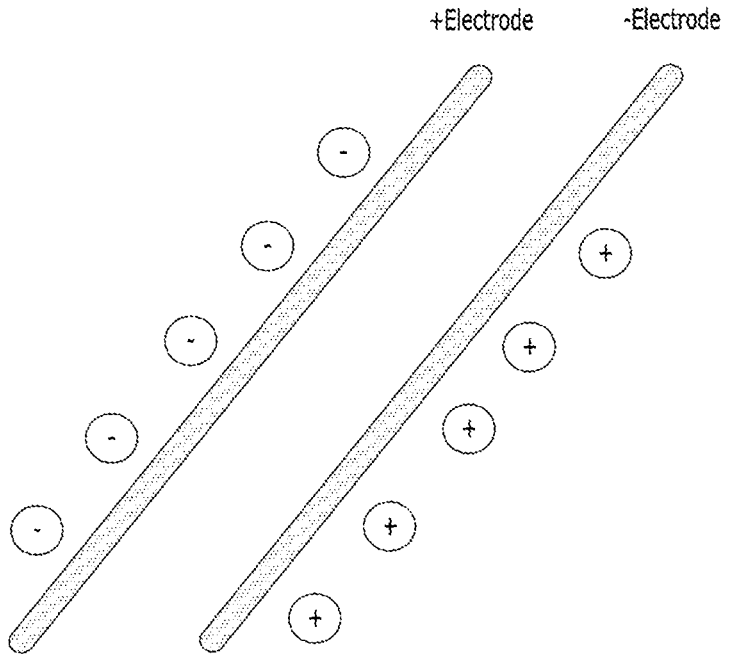
FIG. 6 is a diagram illustrating an initial charge distribution of a known cable sensor.
Figure 7:
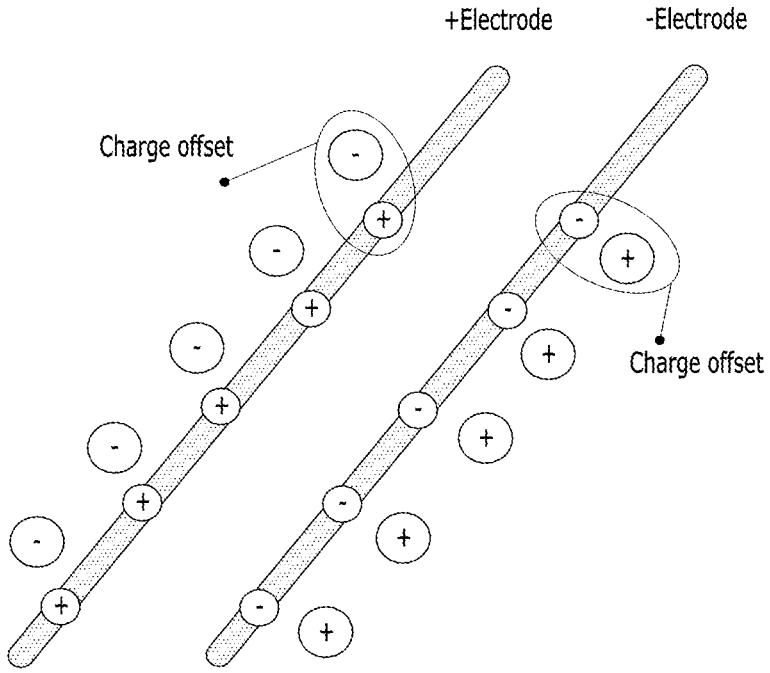
FIG. 7 is a diagram illustrating an initial charge distribution of a detection line including charged and reduced graphene oxide, which is applied to an embodiment of the present disclosure.
Figure 8:
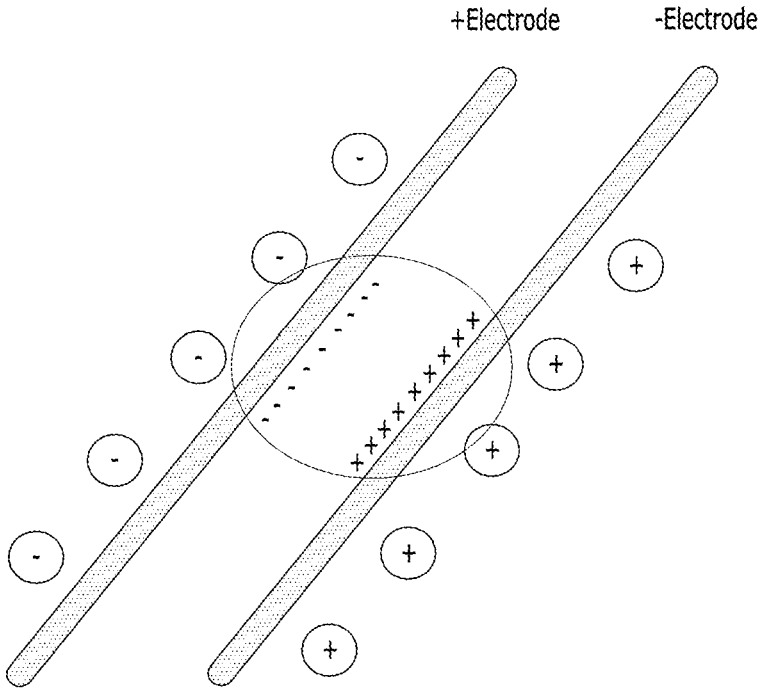
FIG. 8 is a diagram illustrating a charge distribution when a known cable sensor comes into contact with a toxic substance.

FIG. 6 is a diagram illustrating an initial charge distribution of a known cable sensor. FIG. 7 is a diagram illustrating an initial charge distribution of a detection line including charged and reduced graphene oxide, which is applied to an embodiment of the present disclosure. FIG. 8 is a diagram illustrating a charge distribution when a known cable sensor comes into contact with a toxic substance.

Figure 9:
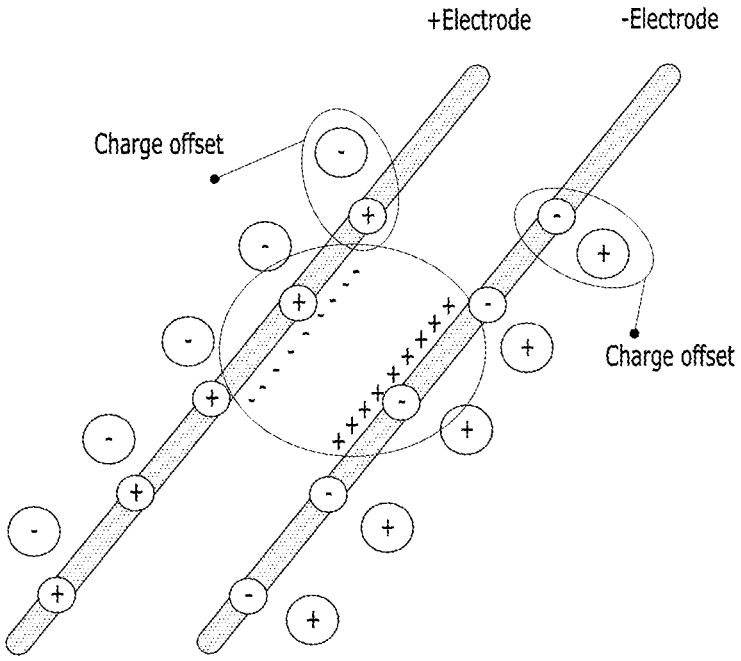
FIG. 9 is a diagram illustrating a charge distribution when a detection line including charged and reduced graphene oxide according to another embodiment of the present disclosure comes into contact with a toxic substance.

Furthermore, FIG. 9 is a diagram illustrating a charge distribution when a detection line including charged and reduced graphene oxide according to another embodiment of the present disclosure comes into contact with a toxic substance.

Referring to FIG. 6, if a conventional electrode does not include a substance having a polarity, charges are distributed to a + electrode and a − electrode, so an initial charge quantity value can be obtained.

FIG. 7 illustrates the state in which a voltage has been applied, if the charged and reduced graphene oxide is coated on the first detection line 130 and the second detection line 230, that is, if the positively charged and reduced graphene oxide is coated on the first detection line 130 used as a + electrode and the negatively charged and reduced graphene oxide is coated on the second detection line 230 used as a − electrode.

When the positively charged and reduced graphene oxide is coated on the + electrode, an initial charge quantity value is lowered because − charges induced by the application of the voltage is offset by the positively charged and reduced graphene oxide.

Referring to FIGS. 8 and 9, if the electrode of a conventional cable sensor does not have a polarity and charged and reduced graphene oxide is coated on the electrode, when the electrode is exposed to a toxic substance, the toxic substance depends on a charge quantity value. Accordingly, current charge quantity values in both cases are similar because the charge quantity values based on the same toxic substance are the same.

Since capacitance depends on the amount of charges, a change in capacitance depends on a difference between a current charge quantity and an initial charge quantity. Accordingly, assuming that a value of the current charge quantity is the same when a value of the initial charge quantity is reduced, a change in the capacitance value is increased, and thus resolution and sensitivity of the cable type liquid leak sensor are improved.

That is, if the charged and reduced graphene oxide is added to the composition for an electrode as in an embodiment of the present disclosure, the amount of charges is affected. Accordingly, the sensitivity of the cable type liquid leak sensor that functions as a capacitance type according to an embodiment of the present disclosure can be improved.

A composition for a capacitance type toxic substance electrode applied to an embodiment of the present disclosure includes a charged and reduced graphene oxide, a binder, a solvent, and a hardener.

Furthermore, the composition for a capacitance type toxic substance electrode according to an embodiment of the present disclosure may further include a dispersant and a volatilization retardant for increasing the dispersibility of charged and reduced graphene oxide.

The binder, which may be used in the composition for a capacitance type toxic substance electrode according to an embodiment of the present disclosure, may include ethylcellulose, polyvinylalcohol, polyvinylpyrrolidone, polyvinylbutyral, poly(methylmetacrylate), polyurethane or polyester, but oil-based fluorine resin may be most preferred for a high acid-resistant property.

The solvent, which may be used in the composition for a capacitance type toxic substance electrode according to an embodiment of the present disclosure, may include 2-ethoxyethanol, ethanol, methanol, toluene, xylene or methyl ethyl ketone.

The dispersant, which may be used in the composition for a capacitance type toxic substance electrode applied to an embodiment of the present disclosure, may include Solspers 20000, Solspers 38500, and BYK 170.

The volatilization retardant, which may be used in the composition for a capacitance type toxic substance electrode according to an embodiment of the present disclosure, may include butyl carbitol acetate and dipropylene glycol dimethyl ether.

The hardener, which may be used in the composition for a capacitance type toxic substance electrode according to an embodiment of the present disclosure, may include any one of BENZOYL PEROXIDE, AZOBISISOBUTYRONITRILE, 2-CYANO-2-PROPYLAZOFORMAMIDE, 2, 2-AZOBIS(2, 4-DIMETHYLVALERONITRILE, (2, 2-AZOBIS[2-(2-IMIDAZOLIN-2-YL)PROPANE]), and (2, 2-AZOBIS(2-METHYLBUTYRONITRILE). Among them, (2, 2-AZOBIS(2, 4-DIMETHYLVALERONITRILE) is mot preferred.

The composition for a capacitance type toxic substance electrode, which is applied to an embodiment of the present disclosure, may be fabricated by performing the steps of mixing the charged and reduced graphene oxide, the binder, the solvent, the dispersant, and the volatilization retardant, primarily dispersing the mixture by stirring the mixture using a homomixer and secondarily dispersing the primarily dispersed mixture using a high pressure disperser, and inputting the hardener to the dispersed mixture.

The hardening may be completed at a hardening temperature of 180° C. after preliminary hardening at 100° C.

The step of primarily dispersing the mixture is the step of mixing the charged and reduced graphene oxide and oil-based fluorine resin with the solvent, which maximizes a capacitance reaction width, and may be performed for one or two hours at 5,000 to 7,000 rpm.

The step of secondarily dispersing the primary mixture using the high pressure disperser increases the coating property and dispersibility of the composition for a capacitance type toxic substance electrode by smashing and dispersing the primary mixture in a high pressure state.

The secondary dispersing may be performed 5 times to 10 times under pressure of 300 to 350 bar.

The hardener is added to the dispersed mixture, and the mixture is stirred using the homomixer at 3,000 to 5,000 rpm for 10 to 30 minutes.

The charged and reduced graphene oxide of 5 to 20 wt %, the binder of 30 to 60 wt %, the solvent of 30 to 50 wt %, the hardener of 20 to 60 wt %, and the dispersant of 5 to 20 wt % may be included with respect to a total weight of the composition for a capacitance type toxic substance electrode.

Furthermore, each of the first cable unit 100 and the second cable unit 200 may have the following structure.

First, a stainless steel (SUS) wire and a common wire having covering are twisted together. The SUS wire functions as an electrode for detecting a leaking liquid. The common wire may be configured to supply a power source.

Second, the aforementioned composition for an electrode including graphene oxide may be configured with a SUS wire coated on an outside surface and a common wire, which are twisted together.

Third, the aforementioned composition for an electrode including graphene oxide may be configured with a SUS wire coated on an outside surface, a SUS wire, and a common wire, which are twisted together. The SUS wire may function as the ground with a signal line and a shield line. The common wire may function as a core wire, a power line, and a signal line.

The cable type liquid leak sensor according to an embodiment of the present disclosure has an advantage in that leaking liquid detection performance is excellent due to excellent adhesion with the surface of the earth when the cable type liquid leak sensor is installed on a bottom because the two cable units maintain an interval by the Teflon thread having a chemical-resistant property or a drug-tolerance property and are braided with flexibility.

Furthermore, since the two cable units maintain a given interval, there is an advantage in that the cable type liquid leak sensor can be selectively used depending on a site situation because a leaking liquid can be detected using the resistance and conductivity methods and can also be detected using the capacitance method because.

Moreover, there is an advantage in that the detection line has an excellent corrosion-resistant property against strong acid having a high concentration and a strong alkali because graphene, that is, a carbon material, and oil-based fluorine resin are used. Furthermore, there is an advantage in that the detection line has excellent responsiveness because a surface of the base is coated using a composition for an electrode including surface-reformed, charged and reduced graphene oxide and thus a change in a capacitance value is great.

Specific parts of the contents of the present disclosure have been described above. Such detailed descriptions are merely preferred embodiments for those having ordinary knowledge in the art, and it will be evident that the scope of the present disclosure is not restricted by the detailed descriptions.

Accordingly, it may be said that a substantial scope of the present disclosure is defined by the accompanying claims and equivalents thereof.

What is claimed is:

1. A cable type liquid leak sensor comprising:

a first cable unit having a first detection line for detecting a leaking liquid and a first power line in parallel twisted with the first detection line in order to supply a power source;

a second cable unit having a second detection line for detecting a leaking liquid and a second power line in parallel twisted with the second detection line in order to supply a power source;

a first fixing unit formed to surround an outside of the first cable unit by a thread made of a material having a chemical-resistant property or a drug-tolerance property;

a second fixing unit formed to surround an outside of the second cable unit by a thread made of a material having a chemical-resistant property or a drug-tolerance property; and a connection unit having both sides braided to couple the first fixing unit and the second fixing unit so that the first cable unit and the second cable unit maintain a given interval.

2. The cable type liquid leak sensor of claim 1, wherein the first fixing unit and the second fixing unit are formed simultaneously when the connection unit is braided.

3. The cable type liquid leak sensor of claim 1, wherein:

the first fixing unit or the second fixing unit is wound along an outer circumference of the first cable unit or the second cable unit by the thread, and a piece of the wound thread has an interval from a piece of a thread wound in a length direction of the first cable unit or the second cable unit.

4. The cable type liquid leak sensor of claim 1, wherein the detection line and the power line are wound on the outside of the first cable unit or the second cable unit around a core wire in a spiral form.

5. The cable type liquid leak sensor of claim 1, wherein:

the first detection line is configured by coating, on a surface of a base having a form of a wire made of stainless steel, a composition for an electrode comprising positively charged and reduced graphene oxide, the second detection line is configured by coating, on a surface of a base having a form of a wire made of stainless steel, a composition for an electrode comprising negatively charged and reduced graphene oxide, the positively charged and reduced graphene oxide is represented by surface charges having an $NH3^+$ functional group, and the negatively charged and reduced graphene oxide is represented by surface charges having a $COO^-$ functional group.

6. The cable type liquid leak sensor of claim 5, wherein each of the compositions for the electrodes comprises the charged and reduced graphene oxide of 5 to 20 wt %, a binder of 30 to 60 wt % which is oil-based fluorine resin, a solvent of 30 to 50 wt %, a hardener of 20 to 60 wt %, and a dispersant of 5 to 20 wt %.

* * * * *